US005137377A

United States Patent [19]

Ito et al.

[11] Patent Number: 5,137,377

[45] Date of Patent: Aug. 11, 1992

[54] DOT MATRIX PRINTER HAVING A PRINT HEAD POSITION ADJUSTING FEATURE DEPENDENT ON THERMAL DEFORMATION OF PLATEN OR THE LIKE

[75] Inventors: Noritugu Ito, Chita; Yuuji Kawahara, Nagoya, both of Japan

[73] Assignee: Brother Kogyo Kabushiki Kaisha, Nagoya, Japan

[21] Appl. No.: 648,860

[22] Filed: Jan. 31, 1991

[30] Foreign Application Priority Data

Jan. 31, 1990 [JP] Japan ..... 2-21408

[51] Int. Cl.[5] ..... B41J 11/20

[52] U.S. Cl. ..... 400/56; 400/59; 400/124

[58] Field of Search ..... 400/54, 55, 56, 57, 400/58, 59, 719, 124 TC

[56] References Cited

U.S. PATENT DOCUMENTS

| | | | |
|---|---|---|---|
| 4,652,153 | 3/1987 | Kotsuzumi et al. | 400/56 |
| 4,877,344 | 10/1989 | Watahiki et al. | 400/719 |
| 4,978,239 | 12/1990 | Alexander et al. | 400/719 |
| 4,990,004 | 2/1991 | Kawahara et al. | 400/59 |
| 5,017,027 | 5/1991 | Koike | 400/58 |
| 5,037,217 | 8/1991 | Suzuki et al. | 400/56 |

FOREIGN PATENT DOCUMENTS

| | | | |
|---|---|---|---|
| 0293236 | 11/1988 | European Pat. Off. . | |
| 0326344 | 8/1989 | European Pat. Off. . | |
| 0224776 | 12/1983 | Japan | 400/719 |
| 0202861 | 11/1984 | Japan | 400/719 |
| 0225763 | 11/1985 | Japan | 400/719 |
| 0191165 | 8/1987 | Japan | 400/55 |
| 0137853 | 6/1988 | Japan | 400/719 |
| 2077194 | 12/1981 | United Kingdom . | |

*Primary Examiner*—Edgar S. Burr
*Assistant Examiner*—John S. Hilten
*Attorney, Agent, or Firm*—Oliff & Berridge

[57] ABSTRACT

In dot impact printers, a platen or a print head may be thermally expanded or contracted due to heat generated from a driver of a print head, with the result that a gap between the print head and a sheet of print paper on the platent varies. In order to maintain a proper gap therebetween regardless of the thermal deformation of the platen and/or print head, a temperature sensor is provided for sensing the temperature of the platen or the print head, and the gap therebetween is adjusted based on the sensed temperature. This adjustment is performed each time when a number of printed characters have reached a predetermined number.

13 Claims, 6 Drawing Sheets

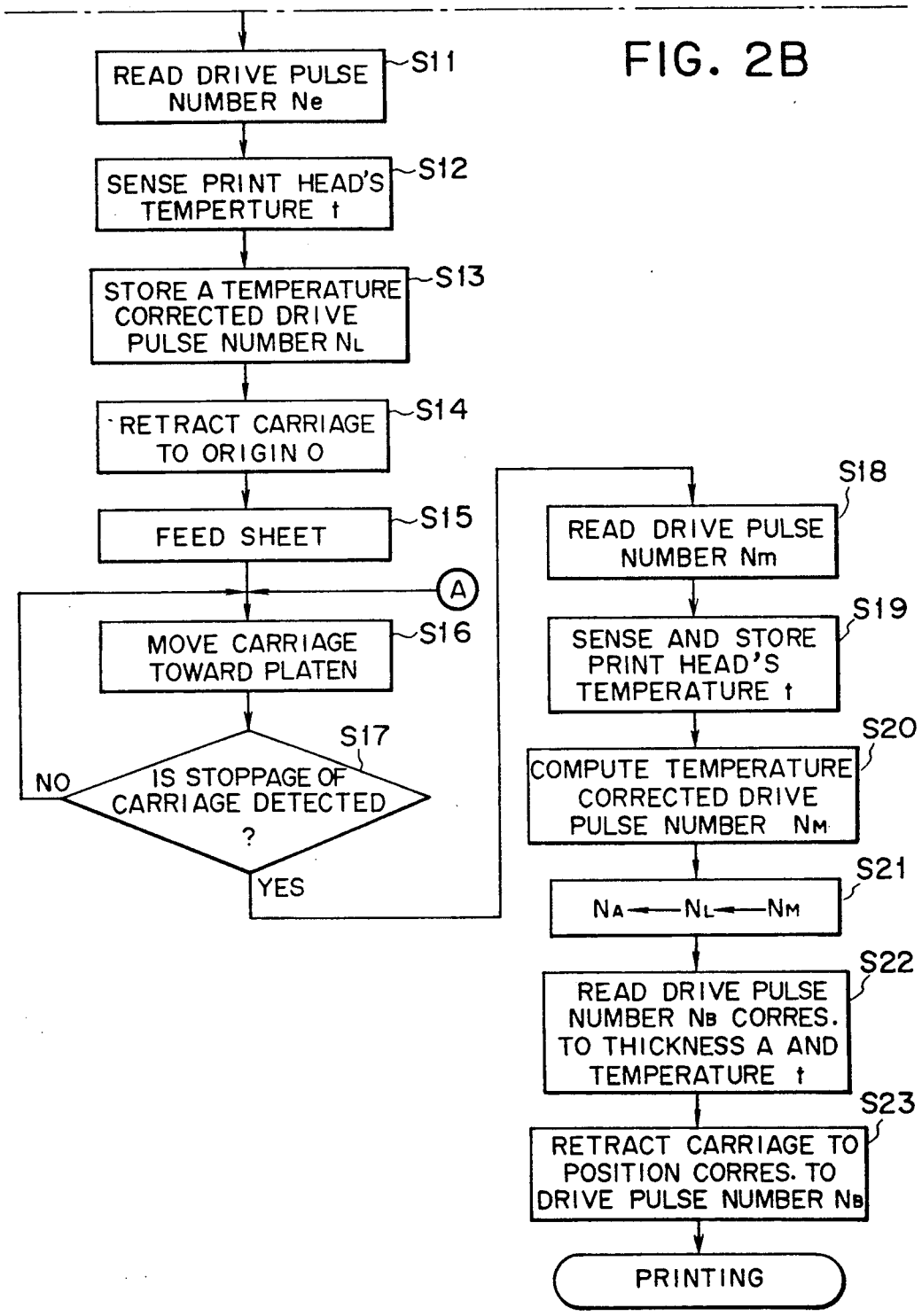
FIG. 2B
READ DRIVE PULSE NUMBER Ne
S11
SENSE PRINT HEAD'S TEMPERTURE t
S12
STORE A TEMPERATURE CORRECTED DRIVE PULSE NUMBER NL
S13
RETRACT CARRIAGE TO ORIGIN O
S14
FEED SHEET
S15
A
MOVE CARRIAGE TOWARD PLATEN
S16
S17
IS STOPPAGE OF CARRIAGE DETECTED ?
NO
YES
S18
READ DRIVE PULSE NUMBER Nm
S19
SENSE AND STORE PRINT HEAD'S TEMPERATURE t
S20
COMPUTE TEMPERATURE CORRECTED DRIVE PULSE NUMBER NM
S21
NA ← NL ← NM
S22
READ DRIVE PULSE NUMBER NB CORRES. TO THICKNESS A AND TEMPERATURE t
S23
RETRACT CARRIAGE TO POSITION CORRES. TO DRIVE PULSE NUMBER NB
PRINTING

DOT MATRIX PRINTER HAVING A PRINT HEAD POSITION ADJUSTING FEATURE DEPENDENT ON THERMAL DEFORMATION OF PLATEN OR THE LIKE

BACKGROUND OF THE INVENTION

The present invention relates to a printer such as a dot matrix printer.

Wire-dot-impact printers have a carriage slidably movable on a guide rod along a platen, a print head for projecting and retracting print wires from and into its distal end, and an ink ribbon. A sheet of print paper is set on the platen and fed as the platen rotates about its own axis. Then, the print wires are selectively controlled to strike the sheet of print paper through the ink ribbon to thereby print desired information on the sheet of print paper. In order to achieve appropriate printing in such printers, it is necessary that a suitable gap be present between the sheet of print paper and the distal end (print wires) of the print head.

Recently, there has been developed a printer which incorporates an adjusting mechanism for automatically adjusting the gap between the sheet of print paper and the print head. The adjusting mechanism includes a pressing/releasing mechanism for moving the carriage toward and away from the platen through angular movement of the guide rod about an axis which is displaced eccentrically off the geometric central axis of the guide rod. Before a printing process is carried out, a ribbon mask on the distal end of the carriage is pressed under predetermined pressure against the sheet of print paper on the platen by the pressing/releasing mechanism, and thereafter the carriage is moved a suitable distance away from the platen by the pressing/releasing mechanism.

When the printer is shipped from the factory, a control device comprising a microcomputer or the like, which controls the printer, stores as a reference position the position of the carriage at the time the ribbon mask is pressed against the platen under a pressure which is the same as the above predetermined pressure. The thickness of the sheet of print paper is detected as the difference between the reference position and the position of the carriage when the ribbon mask is pressed against the sheet of print paper. The carriage is displaced from the sheet of print paper by a preset distance which corresponds to the detected thickness of the sheet of print paper. Therefore, the print head can print desired information on any of various sheets of print paper having various thicknesses, while being spaced from the sheet of print paper by a distance suitable for printing.

When the printer is continuously driven for a long period of time, a considerable amount of heat is generated from a driver of the print head, causing to increase the temperature in the interior of the printer. As the temperature increases, the parts of a printing mechanism are thermally expanded, particularly the print head (print wires) and the rubber-made platen are thermally expanded to a great extent. Due to the thermal expansions of the print head and the platen, the gap between the sheet of print paper and the print head which has been adjusted by the adjusting mechanism is shortened.

If the parts of the printing mechanism are largely deformed due to the thermal expansions, the gap between the sheet of print paper and the print head which has been set to an optimum value varies, with the result that the density of printed information on the sheet of print paper varies, and at worst the printing cannot be achieved appropriately.

SUMMARY OF THE INVENTION

In view of the aforesaid problems of the conventional printers, it is an object of the present invention to provide a printer in which an appropriate gap between the sheet of print paper and the print head can be preserved regardless of thermal expansions or contractions of various parts in a printing mechanism due to thermal change during printing.

To achieve the above and other objects, there is provided a printer for printing characters on a sheet of print paper, which comprises a platen rotatable about its own axis for supporting the sheet of print paper on a circumference thereof; a guide member extending in parallel to the axis of the platen; a carriage slidably movable along the guide member and also movable toward and away from the platen in a direction substantially perpendicular to the axis of the platen, the carriage having a distal end portion confronting the platen; a print head mounted on the carriage for carrying out printing on the sheet of print paper while the carriage is moving along the guide member; a pressing/releasing mechanism for moving the carriage toward and away from the platen; temperature sensing means for sensing a temperature of at least one of the print head and the platen and producing temperature data indicative of the sensed temperature; and adjusting means for adjusting a distance between the sheet of print paper supported on the platen and the print head by actuating the pressing/releasing mechanism based on the temperature data.

The printer may further comprise sheet thickness detecting means for detecting a thickness of the sheet of print paper supported on the platen, the sheet thickness detecting means producing sheet thickness data indicative of the detected thickness of the sheet of print paper, and wherein the adjusting means adjusts the distance therebetween based further on the sheet thickness data.

The printer may further comprise memory means for storing position data regarding a position of the print head to be spaced apart from the sheet of print paper supported on the platen in relation to a temperature and a thickness of a sheet of print paper, and wherein the adjusting means adjusts the distance therebetween based on the position data corresponding to the sensed temperature and the detected thickness of the sheet of print paper supported on the platen.

The printer may further comprise counting means for counting printed characters and producing a count up signal when counting of the printed characters has reached a predetermined number, and wherein the adjusting means adjusts the distance therebetween in response the temperature data produced when the count up signal is produced from the counting means.

In the printer of the present invention, if there is a temperature increase in the platen and/or the print head as the printing operation proceeds, an initially set gap between the sheet of print paper and the print head may no longer be appropriate due to the thermal expansion of the platen and/or the print head. In such a situation, the adjusting means adjust the gap therebetween to an optimum value based on the temperature sensed by the temperature sensing means. Therefore, an optimum gap can always be reserved therebetween regardless of the fact that a printing mechanism is thermally deformed and the gap therebetween is varied.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIGS. 2A and 2B are a flowchart of a process for adjusting a gap between a sheet of print paper on a platen and a print head implemented at the time of commencement of printing;

DETAILED DESCRIPTION OF THE PREFERRED EMBODIMENTS

An embodiment of the present invention as it is applied to a dot matrix printer will hereinafter be described with reference to the drawings.

Figure 3:
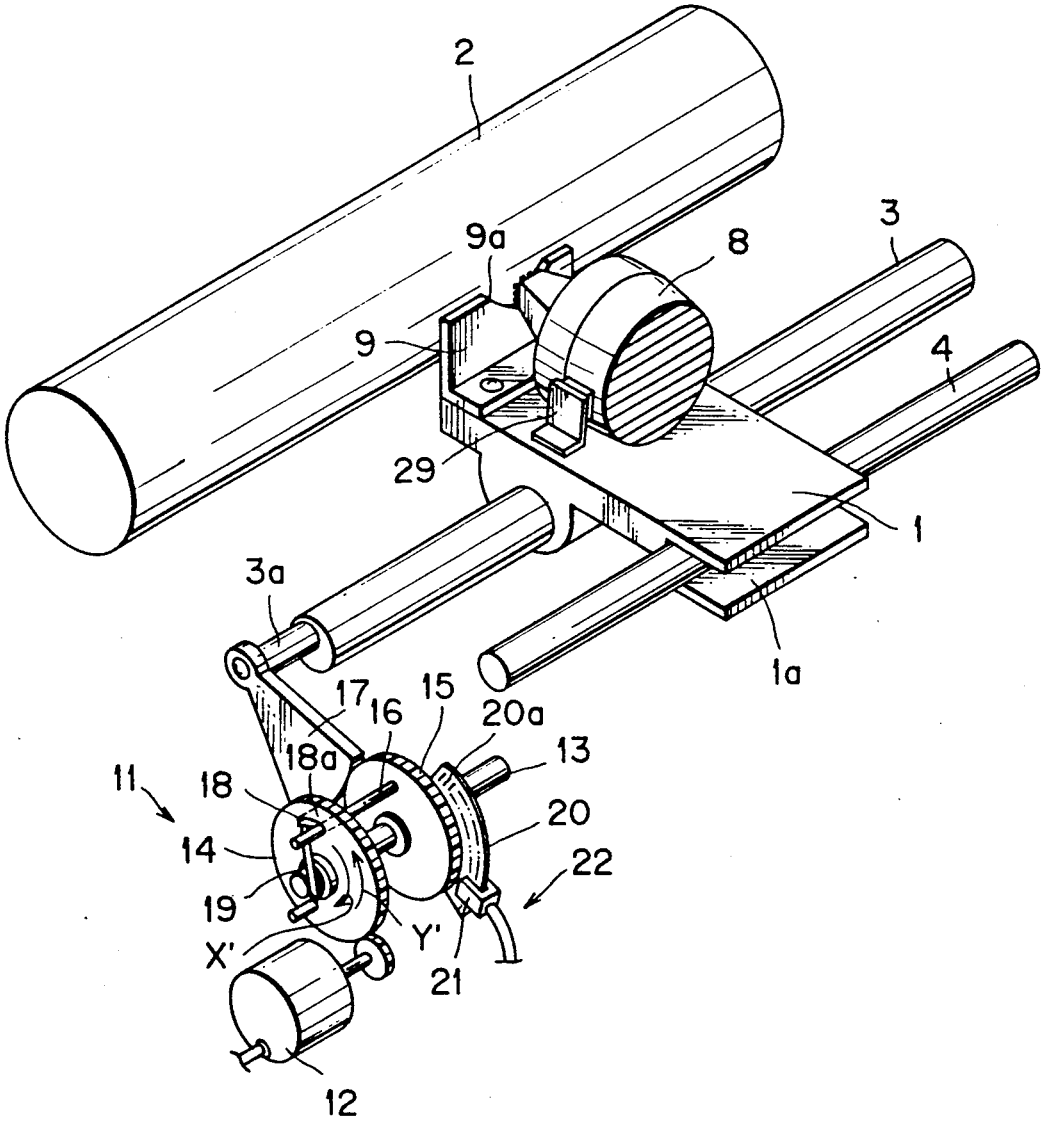
FIG. 3 is a perspective view of a portion of the printer.
Figure 6:
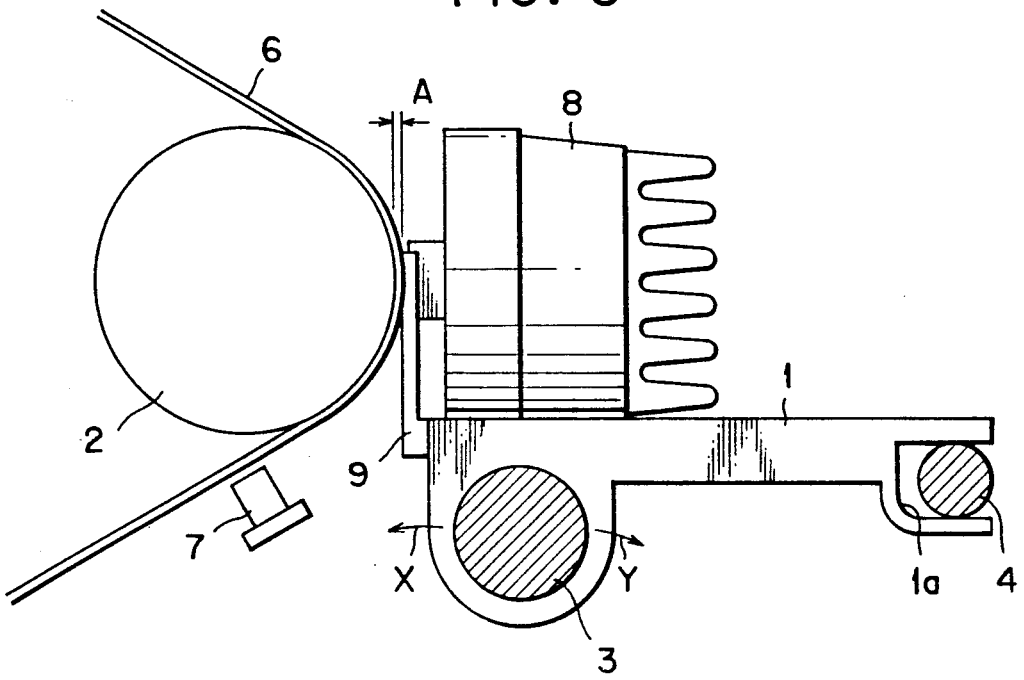
FIG. 6 is a vertical sectional side elevational view showing the position of the carriage when pressed against the sheet of print paper on the platen.
Figure 7:
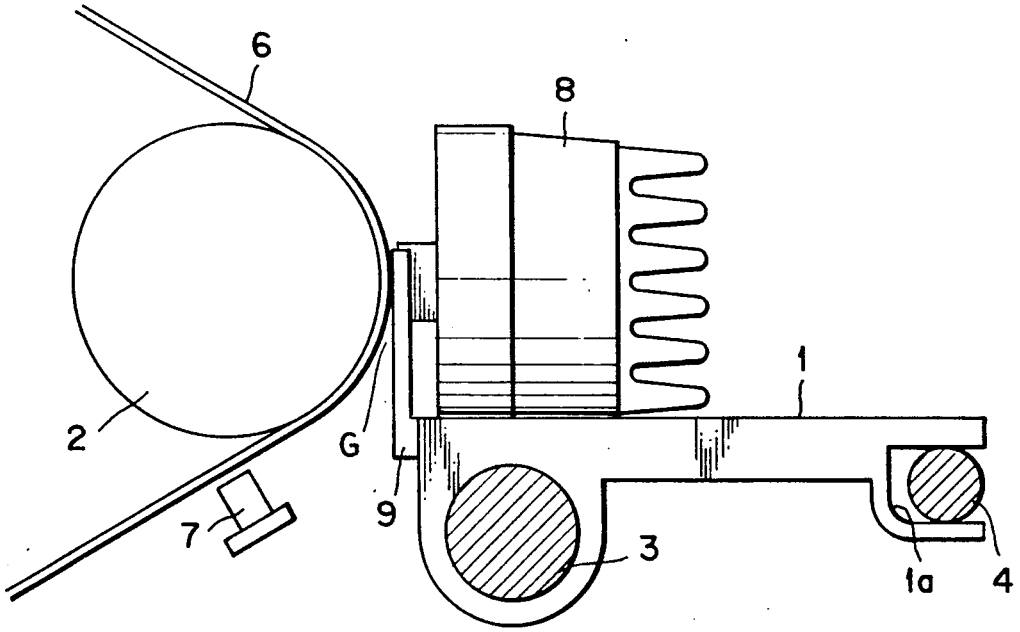
FIG. 7 is a vertical sectional side elevational view showing the position of the carriage when the adjustment of the gap is completed.

FIG. 3 schematically shows a portion of a dot matrix printer. As shown in FIG. 3, a carriage 1 is slidably mounted on a guide rod 3 extending along a platen 2. The carriage 1 has a groove 1*a* formed in an end portion thereof remote from the platen 2, and a fixed rod 4 which extends in a direction in parallel to the guide rod 3 is loosely fitted in the groove 1*a*. The carriage 1 moves along the guide rod 3 by a known carriage actuating mechanism which comprises a pair of pulleys (not shown), a belt (not shown) and a motor 5 (see FIG. 4) for actuating the carriage 1. Both ends of each of the platen 2, the guide rod 3 and the fixed rod 4 are supported on side panels (not shown) of the printer housing. As shown in FIGS. 6 and 7, a sheet sensor 7 for detecting whether a sheet of print paper 6 is set on the platen 2 is disposed near the platen 2.

A print head 8 of the dot-matrix-impact type is mounted on the carriage 1 in confronting relation to the platen 2. A replaceable ink ribbon cassette (not shown) is also mounted on the carriage 1. The carriage 1 also supports, on its distal end facing the platen 2, a ribbon mask 9 for preventing the sheet of print paper 6 from being smeared by an ink ribbon (not shown) travelling between the print head 8 and the sheet of print paper 6. As is well known in the art, the print head 8 has vertical arrays of print wires on its distal end which print wires can be projected toward the platen 2 to press the ink ribbon forwardly through a hole 9*a* formed in the ribbon mask 9. While the carriage 1 is in motion, the print head 8 moves laterally with respect to the sheet of print paper 6 set on the platen 2, and selectively actuates the print wires to thus make dot impressions on the sheet 6 through the ink ribbon. The sheet of print paper 6 is fed onto the platen 2 by the platen 2 rotated by a sheet feed mechanism (see FIG. 4). A temperature sensor 29 serving as a temperature sensing means is mounted on the carriage 1. The temperature sensor 29 senses a temperature of the print head 8, and the sensed temperature data is supplied to a control device 23 (see FIG. 4) to be described later.

In order to achieve appropriate printing with the print head 8, it is necessary that a suitable gap G be present between the sheet of print paper 6 and the distal end of the print head 8. A mechanism for adjusting the gap G will now be described below.

As shown in FIG. 3, the guide rod 3 has, on each of its opposite ends, an integral eccentric shaft 3*a* (only one shown) which is displaced off the geometric central axis of the guide rod 3. The eccentric shafts 3*a* are rotatably supported on the side panels of the printer housing. Therefore, the guide rod 3 is angularly movable about an axis which is displaced off the geometric central axis thereof, in the direction indicated by an arrow X or Y (see FIG. 6), for thereby moving the carriage 1 toward or away from the platen 2. One of the eccentric shafts 3*a* is coupled to a pressing/releasing mechanism 11 which angularly moves the guide rod 3 in one direction or the other. The pressing/releasing mechanism 11 includes a stepping motor 12 whose rotative power is transmitted at a certain speed reduction ratio to a drive gear 14 that is rotatably mounted on a shaft 13. The rotation of the drive gear 14 is transmitted through a pin 16 to a driven gear 15 which is also rotatably mounted on the shaft 13. The rotation of the driven gear 15 is then transmitted to a sector swing gear 17 connected to an outer end of the eccentric shaft 3*a*. The pin 16 has one end fixed to the driven gear 15 and the other end extending through an arcuate slot 18 defined circumferentially in the drive gear 14. The pin 16 is normally urged against one end 18*a* of the arcuate slot 18 by a torsion coil spring 19 coupled to the drive gear 14.

When the stepping motor 12 rotates in a normal direction, the drive gear 14 rotates in the direction indicated by an arrow Y', and the rotation of the drive gear 14 is immediately transmitted to the driven gear 15. The guide rod 3 is angularly moved in the direction indicated by the arrow Y (see FIG. 6) to retract the carriage 1 away from the platen 2. When the stepping motor 12 rotates in the opposite direction, the drive gear 14 rotates in the direction indicated by an arrow X', and the rotation of the drive gear 14 is transmitted through the torsion coil spring 19 and the pin 16 to the driven gear 15. The guide rod 3 is angularly moved in the direction indicated by the arrow X (see FIG. 6) to move the carriage 1 toward the platen 2.

At this time, the movement of the carriage 1 toward the platen 2 is stopped when the ribbon mask 9 on the distal end of the carriage 1 abuts against the platen 2 or the sheet of print paper 6 set on the platen 2. When the load torque imparted on the driven gear 15 exceeds a predetermined level due to the stoppage of the carriage 1, the torsion coil spring 19 is elastically deformed, and no rotation is transmitted to the pin 16, thus stopping the driven gear 15. Stated otherwise, the force with which the carriage 1 abuts against the platen 2 or the sheet of print paper 6 corresponds to the spring force produced by the torsion coil spring 19.

The pressing/releasing mechanism 11 also has an encoder 22 comprising a rotary disc 20 mounted on the driven gear 15 and having an arcuate array of slits 20*a* and a photointerrupter 21 for detecting a light beam as it passes through and is blocked by the rotary disc 20. The encoder 22 serves to detect the position of the carriage 1 at the time when the driven gear 15 is stopped in response to engagement of the carriage 1 with the platen 2 or the sheet of print paper 6, and also to stop the carriage 1 in a position (hereinafter referred to as "an origin 0") sufficiently spaced from the platen 2. An output signal from the encoder 22 is supplied to the control device 23 (FIG. 4) described below.

Figure 4:
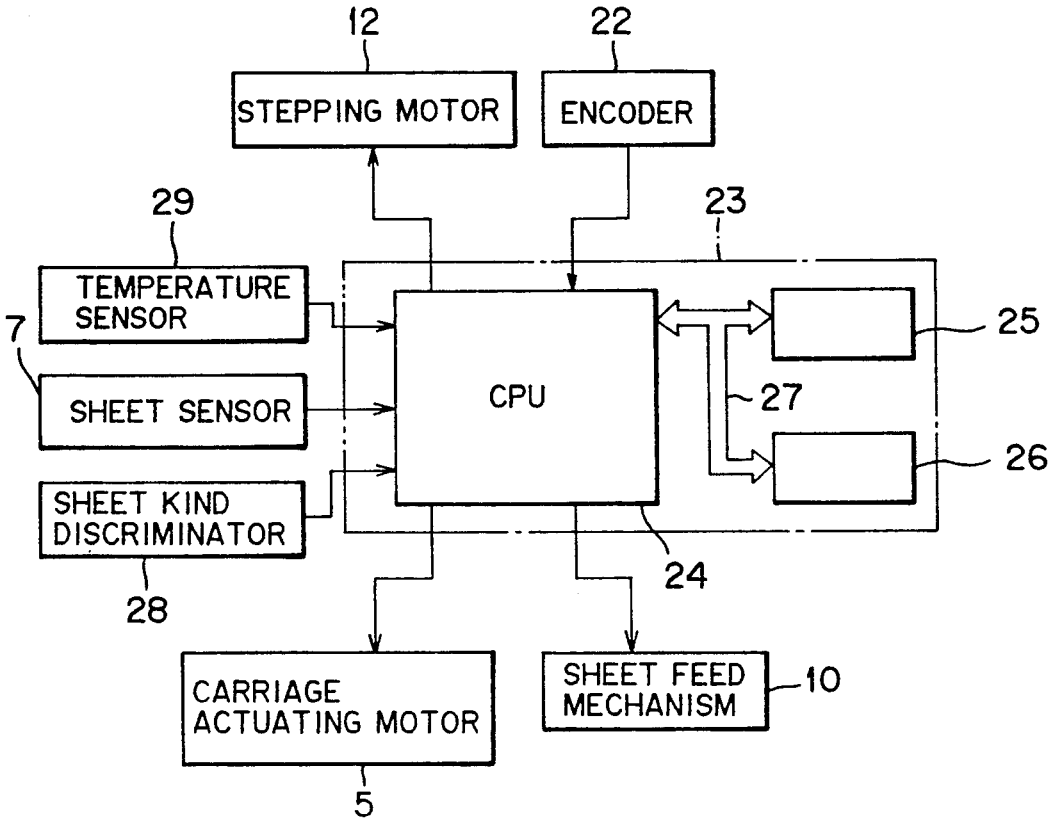
FIG. 4 is a block diagram of the printer.

As shown in FIG. 4, the control device 23 comprises a CPU (central processing unit) 24, a ROM (read-only memory) 25 for storing a program and data, a RAM (random access memory) 26 for temporarily storing various data, and a bus 27 interconnecting the CPU 24, the ROM 25, and the RAM 26. Responsive to the output signals from the sheet sensor 7 and the encoder 22 and the temperature sensor 29, the control device 23 controls energization and de-energization of the stepping motor 12 in accordance with a program to be described later, and provides a gap adjusting means and an adjusting means as defined in the present invention.

The control device 23 counts drive pulses supplied to the stepping motor 12 after it is energized and until it is de-energized, so that the distance which the carriage 1 has moved from the origin 0 is detected as the number of drive pulses supplied to the stepping motor 12. The ROM 25 in the control device 23 stores data regarding the drive pulse numbers NB to be supplied to the stepping motor 12 for moving the carriage 1 from the origin 0 to positions giving optimum gaps G between the print head 8 and the platen 2. In the present embodiment, the optimum gap G varies with the thickness A (corresponding to the number NA of drive pulses, to be described later on) of the sheet of print paper 6. Specifically, the gap G for a thicker sheet of print paper 6 is made to be smaller than that for a thinner sheet of print paper 6, thereby allowing the print head 8 to produce a greater impact force on the thicker sheet of print paper 6. To this end, the ROM 25 stores different data items for the number NB of drive pulses, which data items correspond to different sheet thicknesses or numbers NA of drive pulses. Furthermore, as will be described later, when printing is carried out on the sheet of print paper 6 having a thickness of A, the number NB of the drive pulses varies depending on the temperature t of the print head 8 detected by the temperature sensor 29.

The control device 23 also serves to control the carriage actuating mechanism and the sheet feed mechanism 10. The printer has a sheet kind discriminator 28 such as a limit switch or the like for detecting whether the sheet of print paper 6 is a cut sheet or a continuous sheet. An output signal from the sheet kind discriminator 28 is also supplied to the control device 23.

Figure 2A:
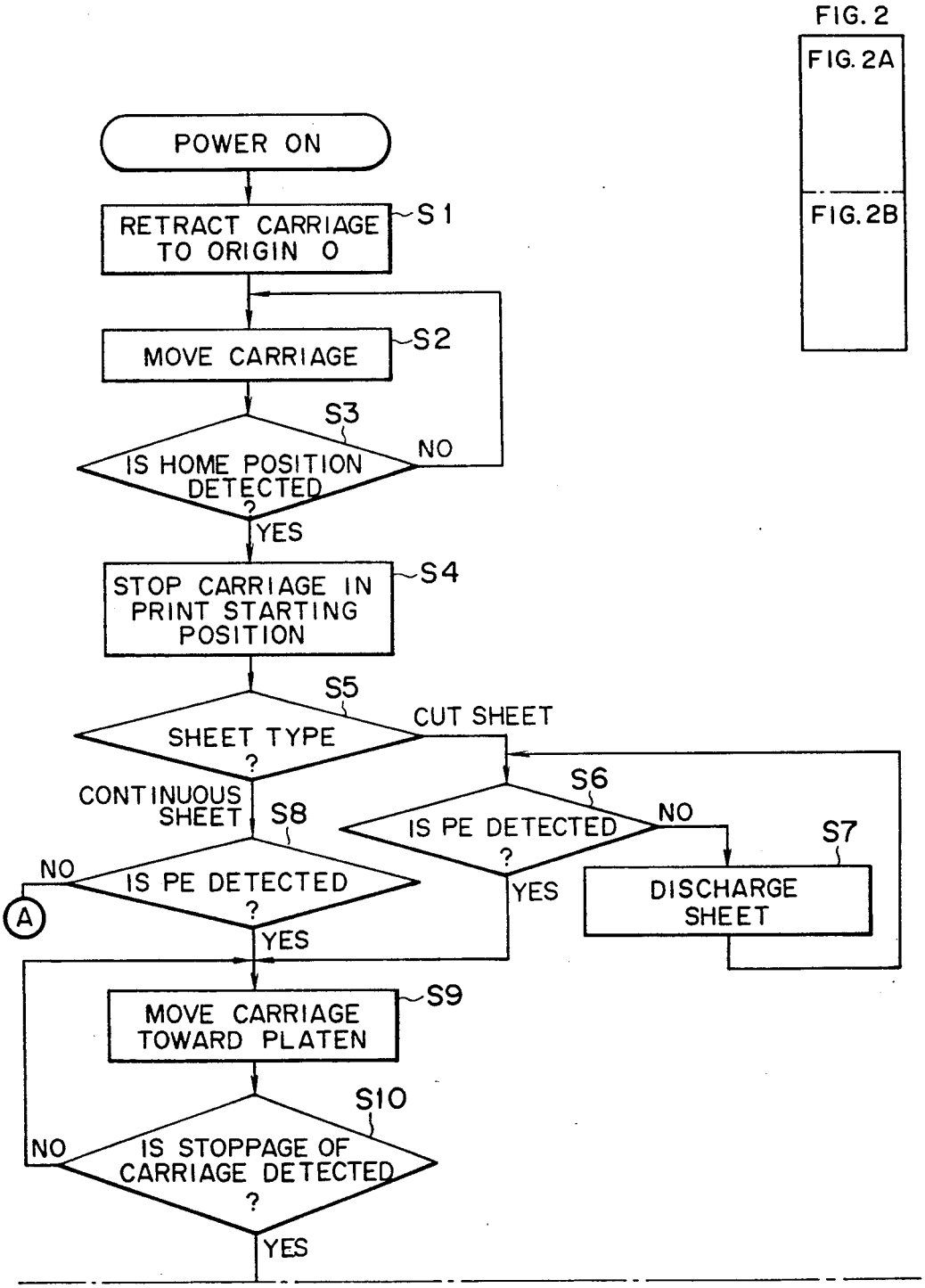

Operation of the printer will be described below. When a power supply switch (not shown) of the printer is turned on, the control device 23 is energized to adjust the gap G between the sheet of print paper 6 and the distal end of the print head 8 according to a procedure or program shown in the flowchart of FIG. 2, which program is stored in the ROM 25.

Steps S1 through S4 of the flowchart indicate a preparatory stage for a printing process, and move the carriage 1, which may be positioned anywhere with respect to the platen 2, to a print starting position. Specifically, the carriage 1 is retracted away from the platen 2 in the direction indicated by the arrow Y by the pressing/releasing mechanism 11, until the carriage 1 reaches and is stopped in the origin 0. The carriage 1 is stopped in the origin 0, i.e., the stepping motor 12 is de-energized, in response to an output signal from the encoder 22. More specifically, while the carriage 1 is moving away from the platen 2, the signal from the encoder 22 changes quickly between high and low levels. When the carriage 22 reaches the origin 0, the signal from the encoder 22 no longer changes in level, and maintains its low or high level for a certain period of time. In response to detection by the CPU 24 of the maintained constant signal level from the encoder 22, the control device 23 de-energizes the stepping motor 12. Then, the carriage 1 is moved along the guide rod 3 until the arrival of the carriage 1 at its home position is detected in steps S2, S3. Thereafter, the carriage 1 is further moved a certain distance along the guide rod 3 and is stopped in the print starting position in a step S4.

The CPU 24 then determines in a step S5 whether the sheet of print paper 6 set in the printer is a cut sheet or a continuous sheet, based on the output signal from the sheet kind discriminator 28. If the sheet of print paper 6 is a cut sheet, then the CPU 24 determines in a step S6 whether the sheet of print paper 6 is set on the platen 2 or not, i.e., whether a paper end (PE) is not detected, based on the output signal from the sheet sensor 7. If the sheet of print paper 6 is set on the platen 2, then the sheet of print paper 6 is discharged out of the printer by the sheet feed mechanism 10 in a step S7. After the sheet of print paper 6 is removed from the platen 2, control proceeds to a step S9. If the sheet of print paper 6 is a continuous sheet in the step S5, then the CPU 24 determines in a step S8 whether the sheet of print paper 6 is set on the platen 2 or not. If not set on the platen 2, then control also goes to the step S9. If set on the platen 2, then control jumps to a step S16.

When no sheet of print paper 6 is being set on the platen 2, the position of the carriage 1 at the time when the ribbon mask 9 on the distal end of the carriage 1 is pressed against the platen 2 is detected and stored in the RAM 26. More specifically, in the step 9, the CPU 24 applies drive pulses to the stepping motor 12 to move the carriage 1 from the origin 0 toward the platen 2 in the direction indicated by the arrow X with the pressing/releasing mechanism 11. The carriage 1 is moved toward the platen 2 until the ribbon mask 9 abuts against the platen 2. At this time, the carriage 1 is pressed against the platen 2 with a force corresponding to the spring force of the torsion coil spring 19. The driven gear 15 and hence the rotary disc 20 are stopped, and the stoppage of the rotary disc 20 is detected by the encoder 22 in a step S10, whereupon the CPU 24 deenergizes the stepping motor 12. The number Ne of drive pulses that have been supplied to the stepping motor 12 until it is de-energized is read out by the CPU 24 in a step S11, which number indicates a distance L (position) of the carriage 1 from the origin 0.

Next, the temperature t of the print head 8 is sensed by the temperature sensor 29 in a step S12, and based on the sensed temperature t, correction of the number Ne of the drive pulses is performed. In a step S13, the corrected number NL of the drive pulses is stored in the RAM 26. Since the number Ne of the drive pulses represents the position of the carriage 1 when it abuts against the platen 2 at the temperature t, the position thereof may be different from a position when the carriage 2 abuts against the platen 2 at a reference temperature, e.g. 20 centigrade, due to the thermal expansion or contraction of the platen 2. Therefore, the number Nl of the drive pulses is corrected based on the sensed temperature t to give a corresponding number NL of the drive pulses at the reference temperature. More specifically, when the sensed temperature t is higher than the reference temperature, the corrected number of the drive pulses NL is given by adding a number Δx to the number Nl of the drive pulses based on data stored in the ROM 25. By this correction, a reference position of the carriage 1 is obtained, which reference position will be used for detecting the thickness of the sheet of paper 6 at the reference temperature (20 centigrade). Thereafter, the CPU 24 energizes the stepping motor 12 to retract the carriage 1 to the origin 0 in a step S14. Then, the sheet feed mechanism 10 feeds the sheet of print paper 6 and sets the same on the platen in a step S15.

After the sheet of print paper 6 is set on the platen 2, the gap G is adjusted in steps S16 through S23 prior to starting a printing process. First, the CPU 24 applies drive pulses to the stepping motor 12 to cause the pressing/releasing mechanism 11 to move the carriage 1 from the origin 0 toward the platen 2 in the direction indicated by the arrow X in a step S16. The carriage 1 is moved until it abuts against the sheet of print paper 6 on the platen 2, as shown in FIG. 6. The carriage 1 is pressed against the sheet of print paper 6 with a force corresponding to the spring force of the torsion coil spring 19. The driven gear 15 and hence the rotary disc 20 are stopped. When the stoppage of the rotary disk 20 is detected by the encoder 22 in the step S17, the CPU 24 de-energizes the stepping motor 12. The number Nm of drive pulses that have been supplied to the stepping motor 12 until it is de-energized is read as indicating a distance M (position) of the carriage 1 from the origin 0 in a step S18.

Thereafter, the temperature t of the print head 8 is sensed by the temperature sensor 29 and sensed temperature data is stored in the RAM 26 in the step S19. In the subsequent step S20, correction of the number Nm of the drive pulses supplied to the stepping motor 12 is performed based on the sensed temperature t in the step S20. Like the processing executed in the step S13, this correction is performed to derive a number NM of the drive pulses from the data stored in the ROM 25 representing the position of the carriage 1 when it abuts against the sheet of print paper 6 set on the platen 2 at the reference temperature (20° centigrade). For example, when the sensed temperature t is higher than the reference temperature, the number NM of the drive pulses is given by adding a number Δx to the number Nm. In the step S21, the CPU 24 performs an arithmetic operation to obtain a number NA of the drive pulses corresponding to the thickness A of the sheet of print paper 6. The number NA of the drive pulses is obtained by subtracting the number NM from the number NL. Since both the numbers NL and NM of the drive pulses are the numbers given at the reference temperature, the number NA of the drive pulses corresponds exactly to the thickness A of the sheet of print paper 6 even if the platen 2 is thermally expanded or contracted during a period of time from the detection of the numbers NL to NM.

Figure 5:
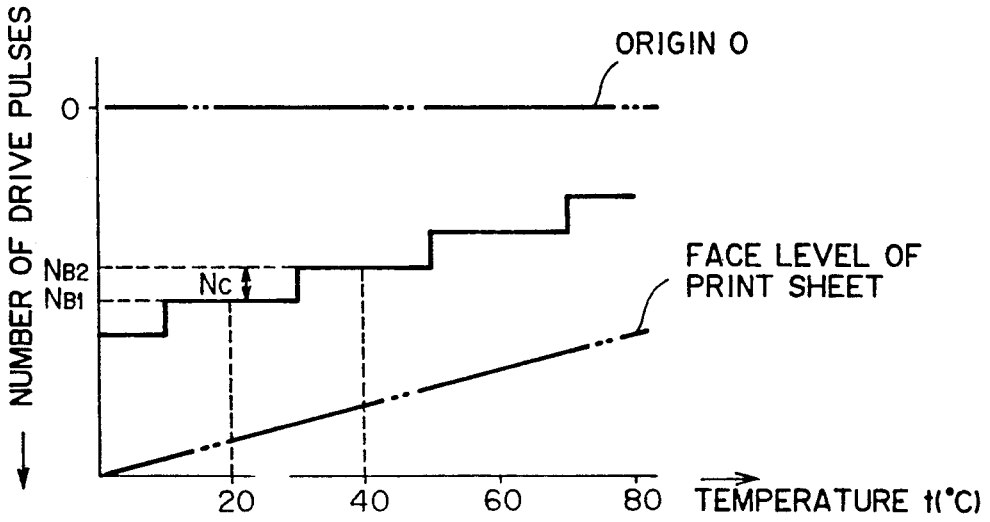
FIG. 5 is a graphical representation showing a relation between a temperature and a carriage stoppage position with respect to a sheet of print paper having a prescribed thickness.

In a step S22, the number NB of the drive pulses is read out from the ROM 25, which number represents the position of the carriage 1 corresponding to the number NA of the drive pulses, i.e., the thickness of the sheet of print paper 6, wherein the temperature t is taken into account. FIG. 5 is a graph showing a relationship between the sensed temperature t and the number NB of drive pulses with respect to a sheet of print paper 6 having a thickness A. As shown therein, the higher the sensed temperature t, the smaller the number NB of the drive pulses becomes, i.e., the closer to the origin 0 is the position of the carriage 1. A table regarding the number NB of the drive pulses corresponding to the number NA of the drive pulses and the sensed temperature t is stored in the ROM 25. In a step S23, the carriage 1 is retracted to the position corresponding to the number NB of the drive pulses (see FIG. 7).

If the sheet of print paper 6 is set on the platen 2 ("NO" in the step S8) and hence the number NL of the drive pulses is not detected, then the number NL of the drive pulses detected in the previous cycle and stored in the RAM 26 is used instead.

The adjustment of the gap G between the sheet of print paper 6 and the print head 8 is now completed, allowing the printer to start printing desired information on the sheet of print paper 6. The printing operation is performed under the state where the carriage 1 is spaced apart an appropriate distance from the sheet of print paper corresponding to the thickness of the paper 6.

Figure 1:
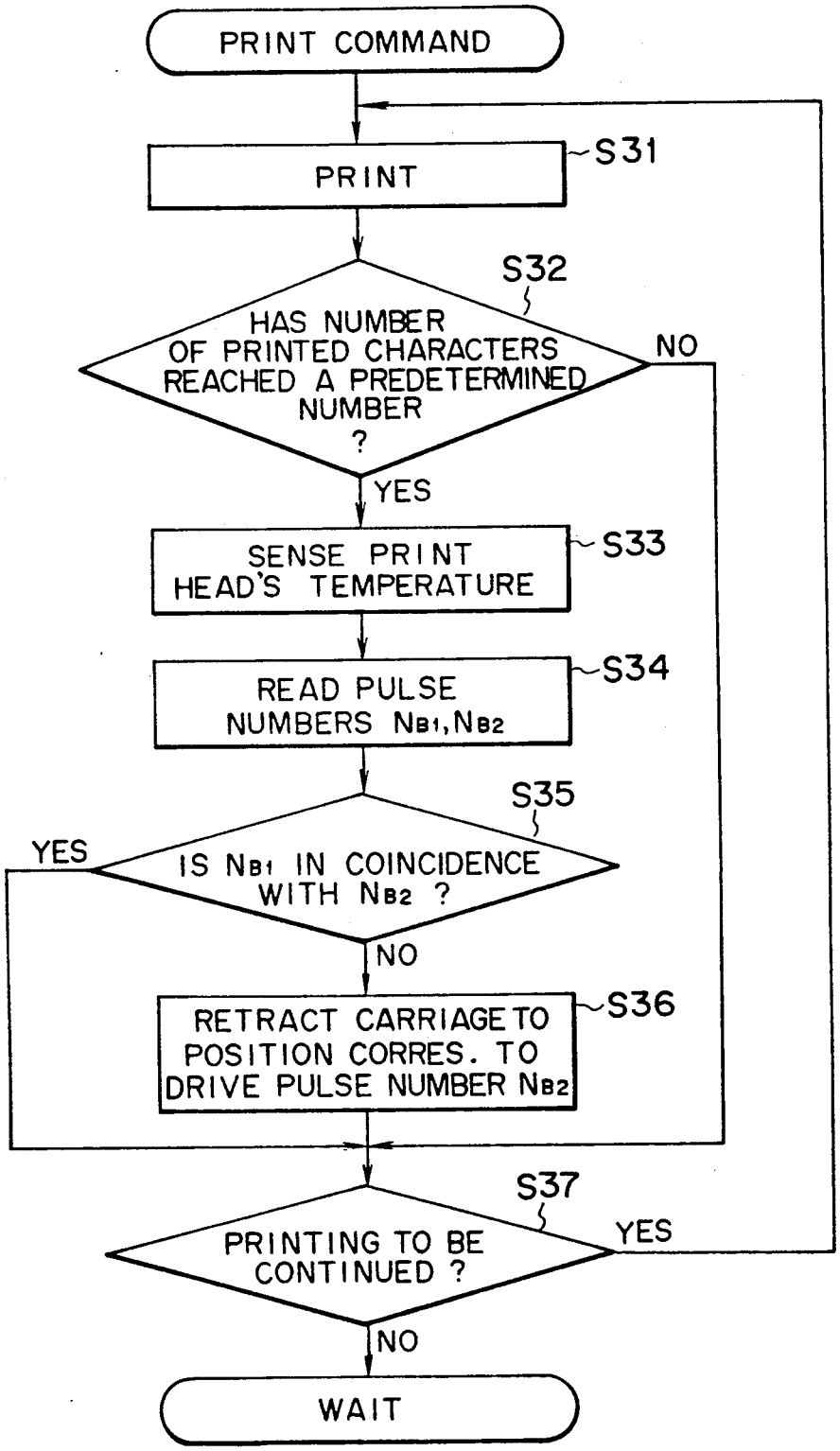
FIG. 1 is a flowchart of a process for correcting the position of a carriage during printing.

After the printing operation is commenced, the retract position of the carriage 1 is corrected in accordance with a procedure (program) shown in the flowchart of FIG. 1, which program has been stored in the ROM 25. A correction means as defined in the present invention corresponds to this procedure executed by the CPU 24.

After the printing operation in a step S31 started in response to a print command, the CPU 24 counts the number of characters which have ever been printed. When the number thereof has reached a predetermined number ("Yes" in a step S32), the temperature of the print head 8 is sensed by the temperature sensor 29 in a step S33. The numbers NB1 and NB2 of the drive pulses representing respectively the presently set retract position of the carriage 1 corresponding to the previously sensed temperature t and a position of the carriage 1 corresponding to the temperature sensed at this time are read out from the ROM 25 in a step S34. These two numbers NB1 and NB2 are then compared with each other in a step S35 to determine whether the number NB1 is in coincidence with the number NB2.

The driver of the print head 8 generates heat as the printing operation proceeds, and thus the temperature of the printer increases. Assuming now that the temperature of the print head 8 measured, for example, prior to the start of the printing operation is 20 centigrade and that the temperature measured at this time is 40° centigrade, the numbers NB1 and NB2 of the drive pulses are different as shown in FIG. 5. That is, the decision made in the step S35 indicates "No" meaning that the previously adjusted gap G is no longer appropriate and is shortened due to the thermal expansion of the platen 2. In this situation, the CPU 24 supplies the NC number of drive pulses which are the difference between the numbers NB1 and NB2 to the stepping motor 12 to thereby perform positional correction of the carriage 1 corresponding to the number NB2 of the drive pulses. At this time, the sensed temperature is newly stored in the RAM 26. The gap G is now corrected to optimum for printing depending on the present temperature.

If the temperature difference is not significantly large, the numbers of the drive pulses being read out coincide with each other ("Yes" in the step S35). In this situation, the correction of the gap G is not performed and the routine proceeds to a step S37. If the printing operation is to be continued ("Yes" in the step S37), the procedure returns to the step S31 where the printing operation is continued. On the other hand, when the printing operation is to be ended ("No" in the step S37), the printer is placed in a wait condition.

In this manner, the adjustment of the gap G is performed each time when a predetermined number of characters are printed. Therefore, even if the platen 2 is thermally expanded or contracted during printing, the printing operation can be continued while maintaining the gap G at an appropriate distance.

As described, according to the present invention, the temperature of the print head 8 is sensed each time when a predetermined number of characters are printed, and the adjustment of the retract position of the carriage 1 is performed depending upon the sensed temperature. Therefore, unlike conventional printers in which the gap between the print head and the sheet of print paper varies from an optimum value due to the thermal expansion or contraction of the platen or other parts, the present invention can provide an appropriate gap G therebetween even if the platen 2 and/or the print head 8 are thermally deformed during printing. As a consequence, the ink ribbon is prevented from getting caught by the print head 8, and desired information can be printed on the sheet of print paper with a suitable ink density without omission of desired ink dots.

Furthermore, in the preferred embodiment of the present invention, the reference position of the carriage 1 for detecting the thickness A of the sheet of print paper 6 is detected when no sheet of print paper 6 is set on the platen 2 each time the power supply of the printer is turned on. Consequently, unlike printers which have reference carriage positions fixed, at the time they start to be used, as they are shipped from the factory, a highly reliable reference position can be established for the carriage even if the platen 2 may be flexed or otherwise deformed after long usage.

While the present invention has been described with respect to a specific embodiment, it can be appreciated for a person skilled in the art that a variety of changes and modifications may be made without departing from the scope and spirit of the present invention. For example, the temperature sensor 29 may be attached to a panel portion adjacent the platen 2 instead of mounting it on the carriage 1 for sensing the temperature of the print head 8. Further, with a plurality of temperature sensors mounted at different positions near the print head 8 and the platen 2, the retract position of the carriage 1 may be corrected responsive to the sensed temperatures by those plurality of sensors. Moreover, the control device 23 may serve as the temperature sensing means instead of using the temperature sensor 29, wherein a temperature increase is computed based on data regarding the number of characters which have ever been printed. In addition, the position of the carriage when it abuts against the platen 2, which position being represented by the number NL of the drive pulses, may be detected only when the printer is shipped from the factory or at a desired interval.

What is claimed is:

1. A printer for printing characters on a sheet of printer paper, comprising:

a platen rotatable about its own axis for supporting the sheet of print paper on a circumference thereof;

a rotatable guide member extending in parallel to the axis of said platen;

a carriage slidably movable along said guide member and also movable toward and away from said platen in a direction substantially perpendicular to the axis of said platen by rotation of said guide member, said carriage having a distal end portion confronting said platen;

means for moving said carriage along said guide member;

a print head mounted on said carriage for carrying out printing on the sheet of print paper while said carriage is moving along said guide member;

a pressing/releasing mechanism attached to said guide member for rotating said guide member;

temperature sensing means for sensing a temperature of at least one of said print head and said platen and producing temperature data indicative of the sensed temperature;

thickness detecting means for detecting a thickness of the sheet of print paper supported on said platen, said sheet thickness detecting means producing sheet thickness data indicative of the detected thickness of the sheet of print paper;

memory means for storing position data regarding a position of said print head to be spaced apart from the sheet of print paper supported on said platen in relation to a temperature and a thickness of the sheet of print paper; and adjusting means for adjusting a printing distance between the sheet of print paper supported on said platen and said print head by actuating said pressing/releasing mechanism based on the position data corresponding to the sensed temperature and the detected thickness of the sheet of print paper supported on said platen.

2. A printer according to claim 1, further comprising counting means for counting printed characters and producing a count up signal when counting of the printed characters has reached a predetermined number, and wherein said adjusting means adjusts the printing distance therebetween in response to the temperature data obtained when the count up signal is produced from said counting means.

3. A printer according to claim 1, wherein said print head is of a dot-matrix-impact type having print wires on a distal end thereof, the print wires projecting toward said platen to thus make dot impression on the sheet of print paper supported on said platen.

4. A printer according to claim 1, wherein said sheet thickness detecting means comprises reference position detecting means for detecting a reference position defined by a position of said carriage when the distal end portion thereof is pressed against the circumference of said platen by said pressing/releasing mechanism with no sheet of print paper on said platen, said reference position detecting means producing reference position data indicative of the detected reference position, sheet face position detecting means for detecting a position of said carriage when the distal end thereof is pressed against the sheet of print paper supported on said platen, said sheet face position detecting means producing sheet face position data indicative of the detected sheet face position, and computing means for computing the sheet thickness data based on the reference position data and the sheet face position data.

5. A printer according to claim 4, wherein said computing means computes the sheet thickness data while taking into account temperatures sensed by said temperature sensing means when the reference position and the sheet face position are detected.

6. A printer according to claim 5, wherein said pressing/releasing mechanism includes a motor for actuating said pressing/releasing mechanism, said motor being rotated when drive pulses are supplied thereto, and wherein each of the reference position data and the sheet face position data is in the form of a number of drive pulses supplied to said motor needed for moving said carriage from a predetermined position spaced apart a predetermined distance from the circumference of said platen to the reference position and the sheet face position, respectively, and the sheet thickness data is in the form of a number of drive pulses corresponding to the thickness of the sheet of print paper.

7. A printer according to claim 6, wherein said adjusting means adjusts the printing distance therebetween by moving said carriage away from the sheet of print paper supported on said platen.

8. A printer according to claim 7, wherein the position data is in the form of a number of drive pulses supplied to said motor, and the number of drive pulses representing the position data is determined so that an optimum distance is reserved between said print head and the sheet of print paper supported on said platen depending on the thickness of the sheet of print paper detected by said sheet thickness detecting means and the temperature sensed by said temperature sensing means.

9. A printer according to claim 4, further comprising sheet sensing means for sensing an absence of the sheet of print paper on said platen, said sheet sensing means producing a sheet absence signal indicative of the absence of the sheet of print paper on said platen.

10. A printer according to claim 9, wherein the reference position is detected by said reference position detecting means when the sheet absence signal is produced from said sheet sensing means.

11. A printer according to claim 10, wherein said platen is rotated when the sheet absence signal is not produced from said sheet sensing means to discharge the sheet of print paper loaded on said platen.

12. A printer according to claim 10, wherein said platen is rotated to load a sheet of paper on said platen when the sheet absence signal is produced from said sheet sensing means, whereupon said sheet face position is detected by said sheet face position detecting means.

13. A printer for printing characters on a sheet of print paper, comprising:

a platen for supporting the sheet of print paper of a surface thereof;

a guide member extending in parallel to the axis of said platen;

a carriage slidably movable along said guide member;

means for moving said carriage along said guide member;

a print head mounted on said carriage for carrying out printing on the sheet of print paper while said carriage is moving along said guide member;

means for changing a distance between said print head and said platen relative to each other;

temperature sensing means for sensing a temperature of at least one of said print head and said platen and producing temperature data indicative of the sensed temperature;

thickness detecting means for detecting a thickness of the sheet of print paper supported on said platen, said sheet thickness detecting means producing sheet thickness data indicative of the detected thickness of the sheet of print paper;

memory means for storing position data regarding a position of said print head to be spaced apart from the sheet of print paper supported on said platen in relation to a temperature and a thickness of the sheet of print paper; and adjusting means for adjusting a printing distance between the sheet of print paper supported on said platen and said print head by actuating said distance changing means based on the position data corresponding to the sensed temperature and the detected thickness of the sheet of print paper supported on said platen.

* * * * *